US011772109B2

(12) United States Patent
Zarfl

(10) Patent No.: US 11,772,109 B2
(45) Date of Patent: Oct. 3, 2023

(54) NOZZLE FOR A NANO-AEROSOL

(71) Applicant: ELYSION FAMILY OFFICE GMBH, Klagenfurt (AT)

(72) Inventor: Hans Peter Zarfl, Wolfsberg (AT)

(73) Assignee: ELYSION FAMILY OFFICE GMBH, Klagenfurt (AT)

( * ) Notice: Subject to any disclaimer, the term of this patent is extended or adjusted under 35 U.S.C. 154(b) by 0 days.

(21) Appl. No.: 17/259,317

(22) PCT Filed: Jul. 9, 2019

(86) PCT No.: PCT/EP2019/068447
§ 371 (c)(1),
(2) Date: Jan. 11, 2021

(87) PCT Pub. No.: WO2020/011803
PCT Pub. Date: Jan. 16, 2020

(65) Prior Publication Data

US 2021/0379610 A1 Dec. 9, 2021

(30) Foreign Application Priority Data

Jul. 13, 2018 (EP) ..... 18183510

(51) Int. Cl.

| | |
|---|---|
| ***B05B 1/26*** | (2006.01) |
| ***B05B 14/00*** | (2018.01) |
| ***B05B 7/00*** | (2006.01) |
| ***B05B 7/24*** | (2006.01) |

(52) U.S. Cl.
CPC ..... *B05B 1/265* (2013.01); *B05B 7/0012* (2013.01); *B05B 7/2435* (2013.01); *B05B 14/00* (2018.02)

(58) Field of Classification Search
CPC ..... B05B 1/265; B05B 14/00; B05B 7/0012; B05B 7/2435; A61M 11/06
USPC ..... 239/124
See application file for complete search history.

(56) References Cited

U.S. PATENT DOCUMENTS

| | | | | |
|---|---|---|---|---|
| 3,580,249 A * | 5/1971 | Takaoka | A61M 11/06 | 239/338 |
| 3,826,255 A * | 7/1974 | Havstad | A61M 16/08 | 239/338 |
| 4,251,033 A * | 2/1981 | Rich et al. | A61H 35/00 | |
| 5,062,419 A * | 11/1991 | Rider | A61M 16/16 | 128/200.14 |
| 5,503,139 A * | 4/1996 | McMahon | A61M 11/06 | 128/200.18 |

(Continued)

FOREIGN PATENT DOCUMENTS

| | | |
|---|---|---|
| GB | 2023023 | 12/1979 |
| JP | 254163419 | 12/1979 |

(Continued)

OTHER PUBLICATIONS

International Search Report for PCT/EP2019/068447 dated Sep. 12, 2019.

(Continued)

*Primary Examiner* — Tuongminh N Pham
*Assistant Examiner* — Kevin Edward Schwartz
(74) *Attorney, Agent, or Firm* — Greer, Burns & Crain, Ltd

(57) ABSTRACT

The invention relates to a device including a nanoaerosol nozzle for releasing an aerosol with very fine particles.

13 Claims, 3 Drawing Sheets

(56) References Cited

U.S. PATENT DOCUMENTS

| | | | | |
|---|---|---|---|---|
| 5,579,757 | A * | 12/1996 | McMahon et al. | B05B 7/0012 239/338 |
| 6,045,058 | A * | 4/2000 | Dobbeling | F23D 11/383 239/404 |
| 6,450,163 | B1 * | 9/2002 | Blacker et al. | A61M 11/06 128/200.21 |
| 8,596,263 | B2 * | 12/2013 | Piper | A61M 16/0666 128/200.18 |
| 9,364,618 | B2 * | 6/2016 | Blacker et al. | A61M 16/20 128/200.18 |
| 9,504,764 | B2 * | 11/2016 | Zarfl | B05B 7/0012 |
| 9,566,211 | B2 | 2/2017 | Brunner | |
| 10,137,260 | B2 * | 11/2018 | Tanaka et al. | A01N 65/22 |
| 2007/0068513 | A1 * | 3/2007 | Kreutzmann | A61M 11/06 128/200.14 |
| 2013/0067656 | A1 | 3/2013 | Brunner | |
| 2017/0100497 | A1 * | 4/2017 | Zarfl | A61M 11/06 |
| 2018/0161531 | A1 * | 6/2018 | Costella | A61M 11/02 |

FOREIGN PATENT DOCUMENTS

| | | |
|---|---|---|
| JP | S55-054240 | 4/1980 |
| WO | WO1995020988 | 8/1995 |
| WO | WO1995020989 | 8/1995 |
| WO | WO2011082838 | 7/2011 |

OTHER PUBLICATIONS

U.S. Pat. No. 4,251,033 of Feb. 17, 1981, Rich et al., an equivalent of JP S55-054240 and JP 554-163419—translation.

* cited by examiner

NOZZLE FOR A NANO-AEROSOL

BACKGROUND

The invention relates to a device including a nanoaerosol nozzle for releasing an aerosol with very fine particles.

Different devices for releasing aerosols are well known. A general problem of these devices is that the aerosol can still contain a lot of relatively big particles of more than 200 nm. FIG. 8 shows a diagram which depicts the particle size of the dispersed aerosol over the concentration. The bell shaped curve shows that there are many particles that are 200 nm or more which results in a mass accumulation of the particles above 200 nm. I.e., the most mass of the dispersed aerosol is present in the big particles which will not be released into the environment which decreases the effectiveness of the device.

The document WO 2011/082838 A1 discloses a method and a device for generating a nano-aerosol, wherein at least one liquid is atomized in a nozzle via a nozzle opening of the nozzle along an outlet direction in the form of liquid particles, the atomized liquid particles are diverted tom the outlet direction and larger liquid particles are at least partially separated from smaller liquid particles, the separated larger liquid particles are returned to the liquid to be atomized and the smaller liquid particles are emitted to the environment. The nozzle comprises a float and a bottom protrusion. The sides and the top of the bottom protrusion is spaced apart from the float in a uniform distance. A cartridge in which the nozzle and the liquid to be atomized are arranged is used. According to the invention, a stream of a carrier gas is generated in the nozzle and at least one liquid to be atomized is brought into contact with the carrier gas. However, although this embodiment is advanced, it still produces many relatively big particles.

SUMMARY

Object of the invention is to reduce the overall particle size of the dispersed aerosol in a manner that the mass of relatively big particles (200 nm to 300 nm or bigger) is reduced. This object is achieved by a device according to claim 1. Further preferred embodiments are depicted in the dependent claims.

The inventive Device for releasing an aerosol comprises a cylindrical upper housing with a cylindrical top protrusion extends downwards from the top wall (preferably centered in the top wall) so that a predetermined space is formed between the inner side of the upper housing and the outer side of the cylindrical top protrusion, wherein the top protrusion comprises a bolt protruding downwards from the bottom end of the top protrusion, and wherein the upper housing comprises at least one opening for releasing the dispersed aerosol, a cylindrical lower housing with a bottom floor, further including a bottom opening in the bottom floor of the lower housing, the opening being preferably central, a cylindrical bottom protrusion enclosing the bottom opening and protruding upwards so that a predetermined space is provided between the inner side of the lower housing and the outer side of the cylindrical bottom protrusion forming a reservoir for the aerosol, a support frame fixedly connected to the inner side of the bottom and/or the side of the lower housing and a float that covers the cylindrical bottom protrusion, wherein the inner circumferential shape of the float matches the outer shape of the cylindrical protrusion and wherein the float is supported by the support frame so that the distance C between the bottom protrusion and the float is essentially the same over the whole circumference, wherein the distance T of the top end of the float to the inner side of the top end of the cylindrical bottom protrusion is greater than the respective circumferential distance C. The higher distance at the top of the bottom protrusion creates a bigger space or a room in which the surface tension of the liquid to be dispensed is broken and the particle size is greatly influenced. This decreases the average particle size and the amount of mass that is accumulated in bigger particles above 200 nm-300 nm is decreases accordingly. That improves the efficiency of the device in comparison to the state of the art. The term Cylindrical is used for any irregular or regular polygonal or circular form such as a square shape, a rectangular shape, a hexagonal shape up to a circle.

Preferably, the lower or the upper housing comprises a side channel for introducing the aerosol into the reservoir. Such a side channel can be used more unlimited in comparison to a pre-filled device. Another option could be to introduce the aerosol-liquid via the air channel through the opening in the bottom of the device.

The distance between the lower end of the bolt and the top of the float preferably have a distance of 3-6 mm, preferably 4.5-5.5 mm, most preferably essentially 5 mm. These distances are ideal for dispersing the liquid ejected by the nozzle.

The bolt can be rounded or chamfered at the end directed downward toward the float, by this geometry, the aerosol ejected by the nozzle gets better dispersed and the small particles can be easier released.

The floor of the lower housing is inclined so that a liquid in the reservoir flows towards the centre of the lower housing. This allows a very efficient use of the aerosol liquid that did not properly disperse in the air and has been returned to the reservoir.

The opening for releasing the dispersed aerosol can be arranged at the top of the top housing above the predetermined space. This ensures that only the small particles can leave the device.

Furthermore, the nozzle opening of the float is preferably formed tapered downwards, i.e. it gets smaller in downwards direction, this enhances the dispersion of the aerosol liquid. The opening of the bottom protrusion is usually formed circular and without any inclination. Preferably, the sidewalls of the opening of the nozzle in the float form an angle with the longitudinal axis of the device of 30°~34° degrees, preferably 31°~0.33°, most preferably 32°.

The support frame can be formed lower than the float, i.e. if the frame includes supporting walls, these walls do not protrude higher in axial direction than the float. That eases the release of the aerosol since in the upper region of the device there are no walls or other obstacles to the opening for releasing the dispersed aerosol.

Figure 1:
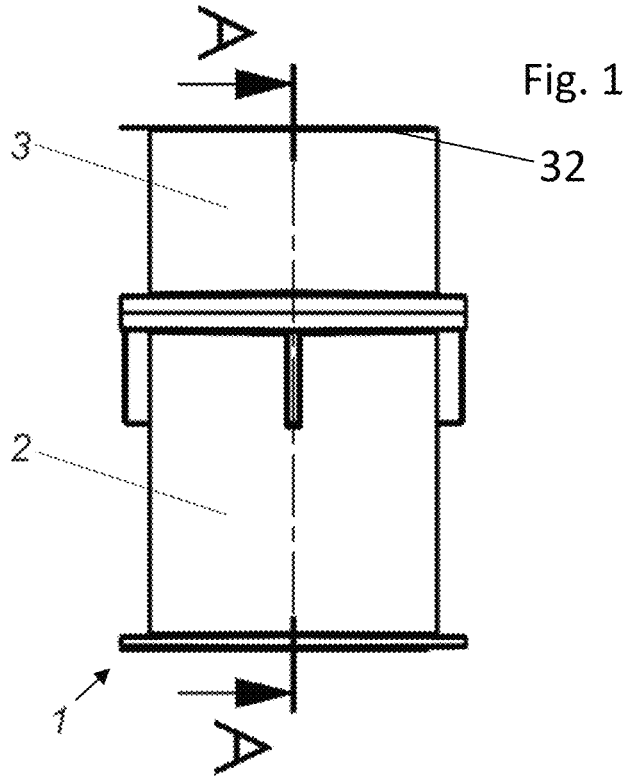
FIG. 1 shows a side view of the device.

DETAILED DESCRIPTION in the following, the terms "axial", "radial" and "circumferential" are used with reference to the longitudinal axis that is shown in FIG. 1 and which is also used as indicator for the section A-A. "Axial" means along the axis, "radial" is a direction perpendicular to the axis and circumferential is around the axis. When used, the directions "up", "down" "left" or "right" are used with reference to FIG. 1 or 2.

Figure 2:
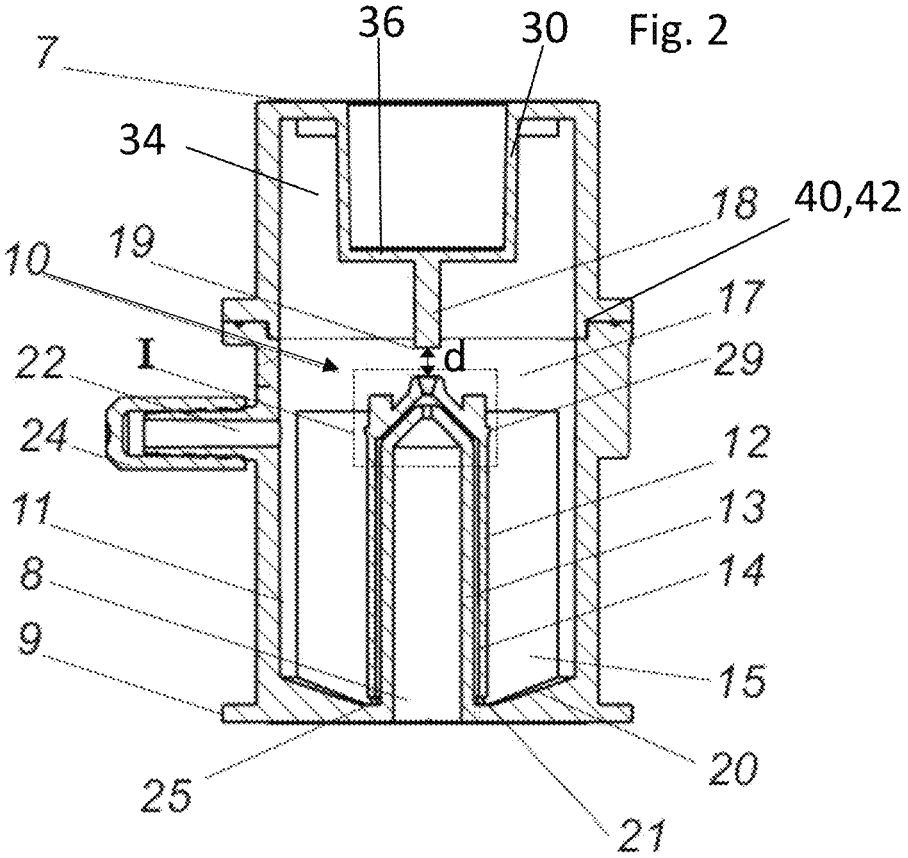
FIG. 2 shows a section longitudinal along the line A-A from FIG. 1.
Figure 3:
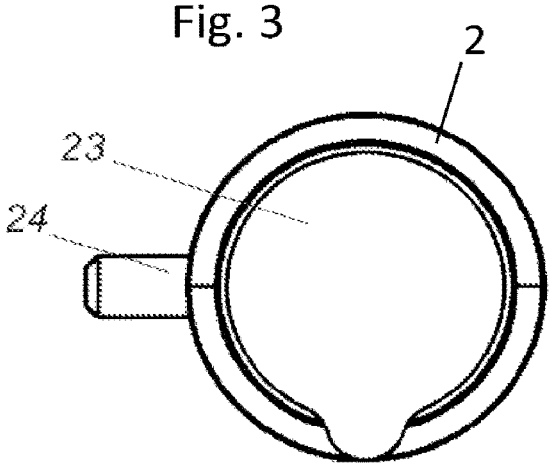
FIG. 3 shows a bottom view of the device from FIG. 1.

FIG. 1 shows the device 1 for releasing an aerosol including the upper housing 3 and the lower housing 2. The section A-A of FIG. 1 is shown in FIG. 2. The upper housing 3 is supported by the lower housing with matching fittings 40, 42 on the circumference of the housings 2, 3 so that the relative position of the upper housing 3 and the lower housing 2 is secured. This allows to use the space within the housing 2, 3 without the need of supporting elements of the upper housing 3 on the inside.

Figure 4:
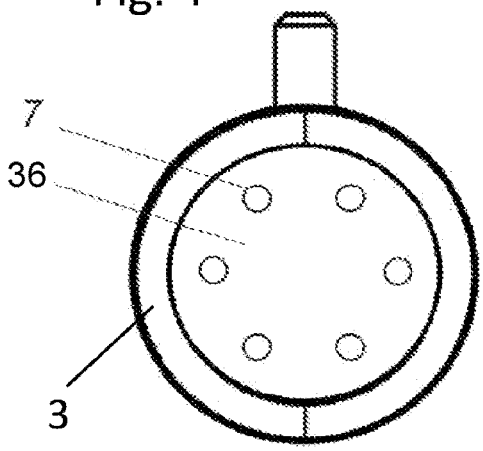
FIG. 4 shows a top view of the device from FIG. 1.
Figure 5:
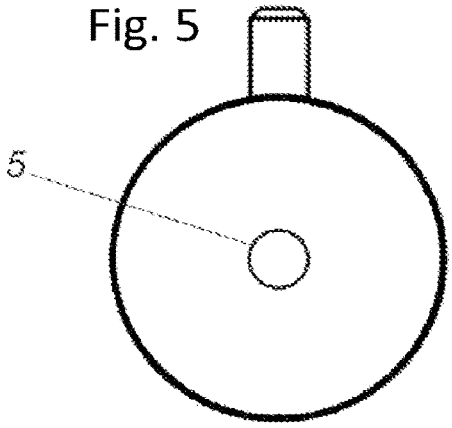
FIG. 5 shows a bottom view of the device from FIG. 1 with a protective film removed.
Figure 6:
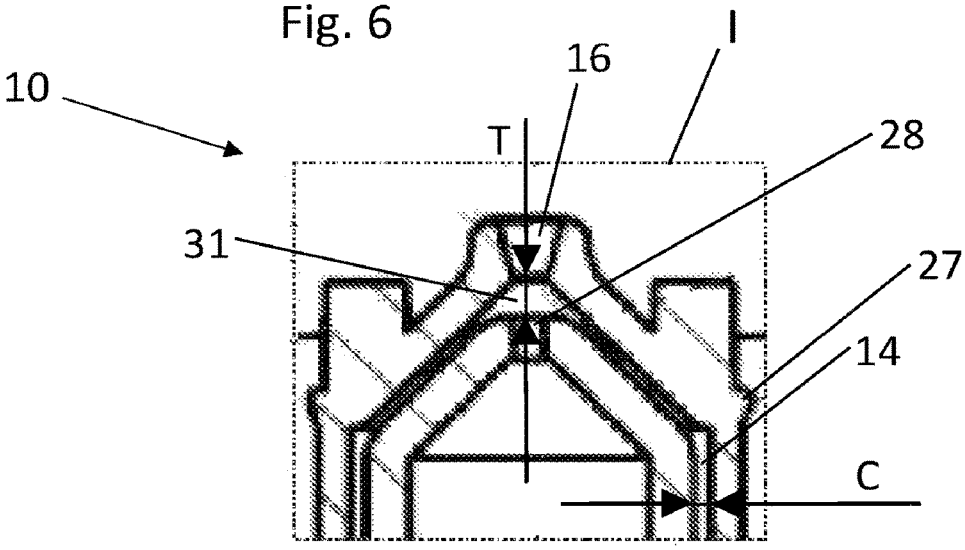
FIG. 6 shows an enlarged portion I of the nozzle from FIG. 2.

The upper housing 3 is shaped cylindrical and comprises a cylindrical or tubular top protrusion 30 that protrudes downwards from the top wall 32 in the direction of the lower housing 2. The top protrusion 30 is preferably circular. Between the top protrusion 30 and the inner wall of the upper housing 3 is a space in which the dispersed aerosol can float and be released to the environment. For releasing the aerosol, the device 1 comprises at least one opening 7 that can be arranged in the upper part of the upper housing 3 anywhere on the side or on the top surface. Most preferably, a plurality of openings 7 are arranged above the space 34 as can be seen in FIG. 4. The top protrusion 30 comprises a bolt 18 which is located at downside of the bottom end 36 of the protrusion 30. The bolt 18 that protrudes also downwards in direction of the lower housing, more specifically towards the float 12 and the bottom protrusion 13 (as described later).

The lower housing 2 is shaped cylindrical as well and comprises an opening in the bottom floor 9. This opening serves an entrance port for pressured air which is used to disperse the aerosol liquid. In an initial state, the underside of the lower housing 2 can be covered by a seal 23 to keep the device protected from contamination. The seal can easily be pulled off before using the device 1. On the inside of the lower housing 2, a bottom protrusion 13 encloses the 5 and serves as a channel 8 for the air. The bottom protrusion 13 is hollow to serve as a first channel for guiding the pressured air to the nozzle 10. On the top of the bottom protrusion 13 an opening 28 through which the air can flow. The opening 28 is a bore, preferably without any inclination of the walls. The opening 28 is about 0.4-0.8 mm more preferably 0.6 mm wide. Between the bottom protrusion 13 and the inner side of the walls of the lower housing 2 is a space 11 that serves as a reservoir for the aerosol liquid. Furthermore, the lower housing comprises a support frame 15 which is fixed to the lower housing via the bottom floor 9 and/or the side walls. The support frame supports a float 12 that is placed on top of the bottom protrusion.

The support frame 15 can be formed in any way that serves the function of holding the float in place. In the preferred embodiment shown in FIG. 2 the support frame is formed as a plurality of walls which are arranged circumferentially around the bottom protrusion 13. These walls have small supporting recesses 29 in the top portion which is connected with a supporting knob 27 of the float 12 to also axially stabilize the float 12. The opening 16 of the float 12 has a distance of about 3-6 mm, preferably 4.5-5.5 mm, most preferably essentially 5 mm.

The float 12 is formed as a hollow cylindrical body. The outside of the float 12 must be combinable with the support frame 15, so that the position of the float 12 is defined within the lower housing 2. The float 12 is placed on and accommodates the bottom protrusion 13. Between the circumferential inside of the float 12 and the circumferential outside of the bottom protrusion, there is a distance C forming second channel 14. This second channel 14 is in the present embodiment ring shaped and preferably between 0.2 mm and 0.6 mm, more preferably 0.35-0.45 mm, most preferably 0.4 mm. The upper portion of the bottom protrusion and the upper portion of the float 12 are tapered, respectively. Preferably, the distance between the tapered portions of the bottom protrusion 13 and the float 12 is smaller than the distance C and have more precisely a distance of about 0.1 mm less than the distance C, in particular a distance of 0.3 mm. That enhances the dispersion of the liquid further. On top of the bottom protrusion 13, the inner surface of the float and the outer surface of the bottom protrusion are diverging so that the distance T between them is greater than the distance C, resulting in a room 31 or space 31. In this room 31, the liquid gets dispersed a first time due to the sudden increase of space and the pressured air that has been guided through the inner channel of the bottom protrusion. The float 12 comprises an opening 16 at the top through which the fluid is ejected into the interior of the device. The opening 16 is preferably tapered, so that the upper end of the opening is wider than the lower end. This achieves a kind of venturi effect. At the smallest portion, the opening 16 is about 0.7~1.1 mm wide, preferably essentially 0.9 mm. The float 12 will not touch the bottom of the lower housing 2, so that there is a gap 25 between the bottom of the lower housing and the float 12 so that the aerosol fluid can be introduced into the second channel 14.

On the side of the lower housing 3 can be provided a side channel 22 for filling the reservoir with aerosol fluid. The side channel 22 can be covered by a lid 24. Essentially, there are three ways to fill the aerosol fluid into the reservoir. Firstly, it can be pre-filled so that the device is essentially usable one time. Secondly, the aerosol fluid can be introduced via the bottom opening 5 and the first channel 8. For this, the air hose for supplying the pressured air into the device has to be connected to a hose for supplying the aerosol fluid. This means that the aerosol fluid is initially introduced via the channel for the pressured air and only the bigger particles will flow back into the reservoir as described later. And thirdly, the device can be filled by means of the side channel 22. This allows the re-use of the device without contaminating other parts like the first channel.

In the following, the use of the device 10 is described as it is shown in the Figures. In the beginning, the seal 23 is pulled off and the opening 5 is connected to an air supply that provides pressured air into the channel 8. The pressure can be for instance 2 bar, but can be adjusted for the specific use of the device 1. The side channel 22 is connected to an aerosol fluid supply. Then the aerosol fluid is introduced into the reservoir 11 and the air flows through the channel 8, the nozzle 10 (i.e. the openings 28 and 16) into the interior of the device 1. Due to the air flow, in the second channel is generated an underpressure (negative pressure) and the aerosol in the reservoir 11 is now sucked into the second channel 14 and transported into the room 31. In this room, the surface tension of the fluid is broken and the fluid is dispersed the first time. Then it gets ejected through the opening 16 into the disperse portion 19 of the interior of the device and gets guided sideways by the bolt 18, in the space 17, there are generated cyclones rotating vertical around the nozzle. Then the dispersed particles smaller than 200-300 nm are carried out by the air stream and are released into the environment. The bigger particles will then sink back into the reservoir 11 for the further dispersion.

Figure 7:
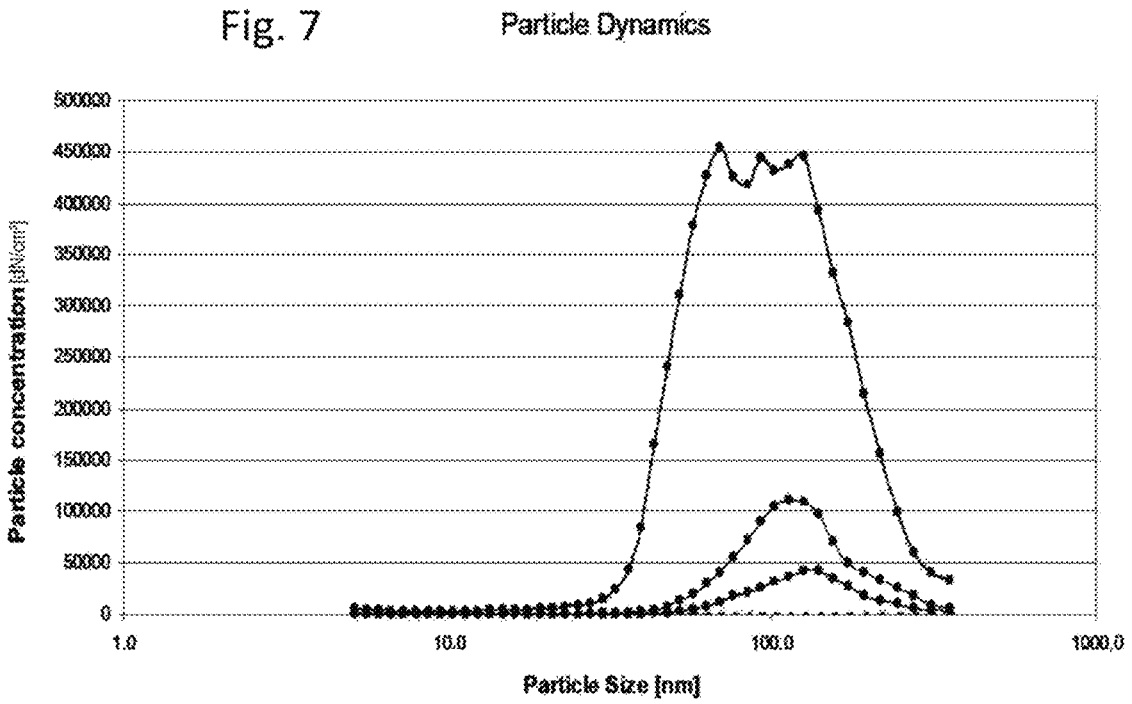
FIG. 7 shows a diagram of the size of the dispersed aerosol particles over the amount of occurrence for the present invention.
Figure 8:
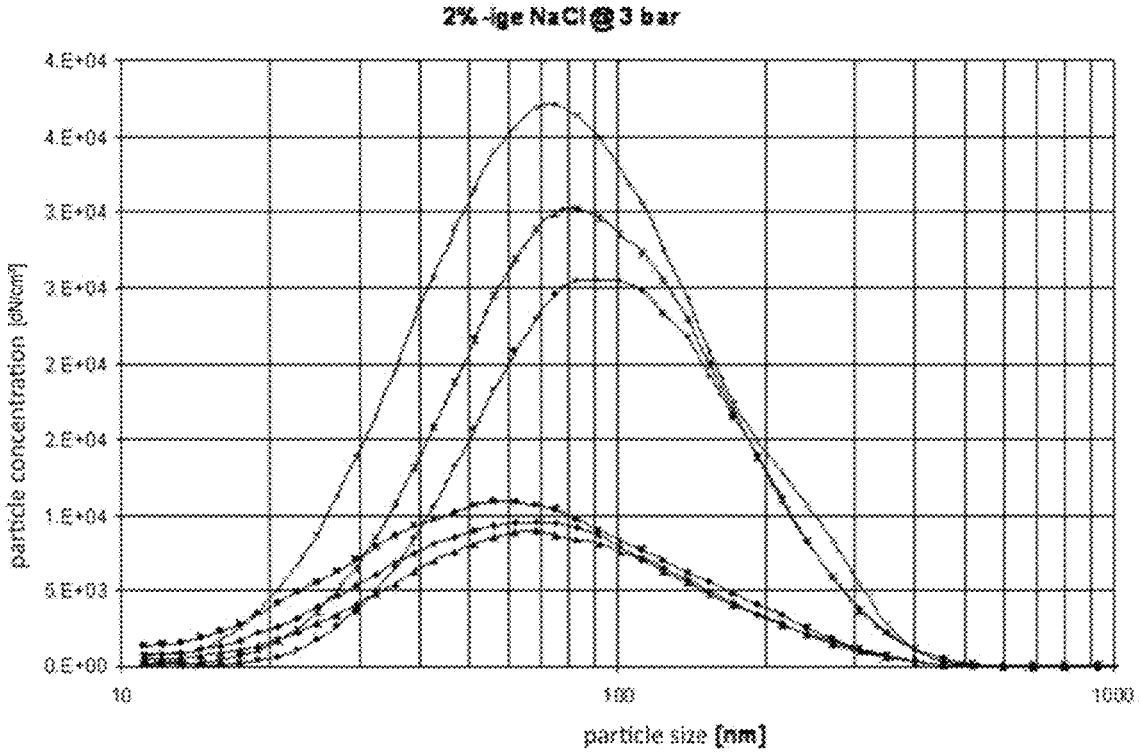
FIG. 8 shows a diagram of the size of the dispersed aerosol particles over the amount of occurrence of the prior art devices.

As can be seen in FIG. 7, the invention leads to a distribution in which the curve is not bell shaped as in the diagram of the prior art in FIG. 8. This means that the biggest part of the mass consists of particles with a size of less than 200 nm and, accordingly, the dispersion of the particles is strongly improved.

REFERENCE NUMBERS device 1
lower housing 2
upper housing 3
bottom opening 5
opening 7
first channel 8
bottom floor 9
nozzle 10
space forming a reservoir 11
float 12
cylindrical bottom protrusion 13
second channel 14
support frame 15
nozzle opening 16
cyclon space 17
bolt 18
disperse portion 19
floor of the lower housing 20
side channel 22
removable seal 23
cap 24
bottom gap 25
supporting knob 27
opening of the bottom protrusion 28
supporting recess 29
cylindrical top protrusion 30
room 31
top wall 32
space in upper housing 34
bottom end of the top protrusion 36
matching fittings 40, 42

The invention claimed is:

1. A device for releasing an aerosol, comprising:

a cylindrical upper housing with:

a cylindrical top protrusion which extends downwards from a top wall of the upper housing so that a first predetermined space is formed between a circumferential inner side of the upper housing and an outer side of the cylindrical top protrusion, wherein the cylindrical top protrusion comprises a protruding structure protruding downwards from a bottom end of the cylindrical top protrusion, and wherein the upper housing comprises at least one opening for releasing the dispersed aerosol;

a cylindrical lower housing with a bottom floor, further including:

a bottom opening in the bottom floor of the lower housing;

a cylindrical bottom protrusion enclosing the bottom opening and protruding upwards so that a second predetermined space is provided between an inner side of the lower housing and an outer side of the cylindrical bottom protrusion forming a reservoir for the aerosol;

a support frame fixedly connected to an inner side of the bottom floor and/or a side of the lower housing; and a float that covers the cylindrical bottom protrusion, wherein an inner circumferential shape of the float matches an outer shape of the cylindrical bottom protrusion and wherein the float is supported by the support frame so that a distance C between the cylindrical bottom protrusion and the float is the same over a whole circumference of the cylindrical bottom protrusion, wherein an upper portion of the cylindrical bottom protrusion and an upper portion of the float are tapered, wherein an inner surface of the float and an outer surface of the cylindrical bottom protrusion diverge so that the inner surface of the float is linearly tapered to a nozzle opening in the float, and the outer surface of the cylindrical bottom protrusion is rounded to an opening in the bottom protrusion, such that a distance T from a top end of the cylindrical bottom protrusion to an inner side of a top end of the float is greater than the respective distance C defining a space, and a distance between the tapered upper portion of the bottom protrusion and the tapered upper portion of the float is smaller than the distance C.

2. The device according to claim 1, wherein the lower housing or the upper housing comprises a side channel for introducing the aerosol into the reservoir.

3. The device according to claim 1, wherein a distance d between a lower end of the protruding structure and the top end of the float is 3-6 mm.

4. The device according to claim 3, wherein the distance d between the lower end of the protruding structure and the top end of the float is 4.5-5.5 mm.

5. The device according to claim 4, wherein the distance d between the lower end of the protruding structure and the top end of the float is 5 mm.

6. The device according to claim 1, wherein the protruding structure is rounded or chamfered at an end directed downwards.

7. The device according to claim 1, wherein a floor of the lower housing is inclined so that a liquid in the reservoir flows towards a center of the lower housing.

8. The device according to claim 1, wherein the at least one opening for releasing the dispersed aerosol is arranged at a top of the upper housing above the predetermined space.

9. The device according to claim 1, wherein the nozzle opening of the float is formed tapered downwards.

10. The device according to claim 9, wherein sidewalls of the nozzle opening form an angle with the longitudinal axis of the device of 30°-34°.

11. The device according to claim 10, wherein the sidewalls of the nozzle opening form an angle with the longitudinal axis of the device of 31°-33°.

12. The device according to claim 11, wherein the sidewalls of the nozzle opening form an angle with the longitudinal axis of the device of 32°.

13. The device according to claim 1, wherein a top of the support frame is lower than the top end of the float.

* * * * *